US007136018B2

(12) United States Patent
Iguchi et al.

(10) Patent No.: US 7,136,018 B2
(45) Date of Patent: Nov. 14, 2006

(54) PORTABLE RADIO

(75) Inventors: Akihiko Iguchi, Moriguchi (JP); Misako Sakae, Hirakata (JP); Yuki Satoh, Osaka (JP)

(73) Assignee: Matsushita Electric Industrial Company, Ltd., Osaka (JP)

( * ) Notice: Subject to any disclaimer, the term of this patent is extended or adjusted under 35 U.S.C. 154(b) by 16 days.

(21) Appl. No.: 10/519,361

(22) PCT Filed: Jul. 1, 2004

(86) PCT No.: PCT/JP2004/009688

§ 371 (c)(1),
(2), (4) Date: Dec. 28, 2004

(87) PCT Pub. No.: WO2005/004276

PCT Pub. Date: Jan. 13, 2005

(65) Prior Publication Data

US 2005/0231428 A1 Oct. 20, 2005

(30) Foreign Application Priority Data

Jul. 8, 2003 (JP) ..... 2003-193425

(51) Int. Cl.
*H01Q 1/24* (2006.01)

(52) U.S. Cl. ..... 343/702

(58) Field of Classification Search ..... 343/702, 343/700 MS, 895; 455/566, 575.3
See application file for complete search history.

(56) References Cited

U.S. PATENT DOCUMENTS 5,649,306 A * 7/1997 Vannatta et al. ..... 455/575.7
6,342,859 B1 * 1/2002 Kurz et al. ..... 343/702
6,600,450 B1 * 7/2003 Efanov et al. ..... 343/726
6,781,551 B1 * 8/2004 Gerber ..... 343/702
2001/0050643 A1 12/2001 Egorov et al. ..... 343/702
2002/0180651 A1 12/2002 Hareyama ..... 343/702
2004/0027298 A1 2/2004 Iguchi et al. ..... 343/702
2004/0125073 A1 * 7/2004 Potter et al. ..... 345/156
2006/0097927 A1 * 5/2006 Satoh et al. ..... 343/702

FOREIGN PATENT DOCUMENTS

| | | |
|---|---|---|
| EP | 1 098 387 | 5/2001 |
| EP | 1 309 156 | 5/2003 |
| JP | 2000 278024 | 10/2000 |
| JP | 2003-8320 | 1/2003 |
| JP | 2003-60417 | 2/2003 |
| JP | 2003-101335 | 4/2003 |

* cited by examiner

*Primary Examiner*—Shih-Chao Chen
*Assistant Examiner*—Minh Dieua
(74) *Attorney, Agent, or Firm*—Steptoe & Johnson LLP

(57) ABSTRACT

The present invention provides a portable transceiver where a broadband of an antenna characteristic can be realized and efficiency is improved. The present invention provides a portable transceiver includes a first housing (7) having a first circuit board (5) in its inside and an input section at its surface, a second housing (8) having a second circuit board (6) in its inside and a display section at its surface, and a coupling section (4) for electrically coupling the first circuit board (5) with the second circuit board (6). An antenna section (3) and an element section (9) are disposed at one of the circuit boards, and the first housing (7) and the second housing (9) are coupled with each other via a hinge section (2) and can be folded.

19 Claims, 7 Drawing Sheets

PORTABLE RADIO

This application is a U.S. national phase application of PCT international application PCT/JP2004/009688.

TECHNICAL FIELD

The present invention relates to a portable transceiver such as a portable telephone.

BACKGROUND ART

Recently a built-in antenna has been commonly used in a field of a radio communication device, particularly a portable transceiver.

A perspective view of a conventional folding portable transceiver is shown in FIG. 9.

Built-in antenna section 103 is disposed near hinge section 102 and close to coupling section 104. Keyboard side board 105, which is a first circuit board, is coupled with liquid crystal display side board 106, which is a second circuit board, via coupling section 104. Keyboard side board 105 is covered with first housing 107 having an input section at its surface. Liquid crystal display side board 106 is covered with second housing 108 having a display section.

An example of the portable transceiver having the structure mentioned above is disclosed in Japanese Patent Unexamined Publication No. 2003-8320.

In a case of built-in antenna section 103 disposed near hinge section 102 shown in FIG. 9, when portable transceiver 101 is opened and shut, an input impedance of built-in antenna section 103 changes.

In particular, when portable transceiver 101 is shut, current distribution concentrates and an impedance characteristic deteriorates because built-in antenna section 103 is close to coupling section 104. Therefore, it is difficult to work at a broadband.

The present invention provides a portable transceiver where a broadband of an antenna characteristic can be realized and efficiency is improved.

SUMMARY OF THE INVENTION

The present invention provides a portable transceiver includes the following elements: a first housing having a first circuit board in its inside and an input section at its surface; a second housing having a second circuit board in its inside and a display section at its surface; a coupling section for electrically coupling the first circuit board with the second circuit board; a hinge section for coupling the first housing with the second housing and capable of folding them. An antenna section and an element section are disposed at one of the first circuit board and the second circuit board.

DETAILED DESCRIPTION OF PREFERRED EMBODIMENTS

Figure 1:
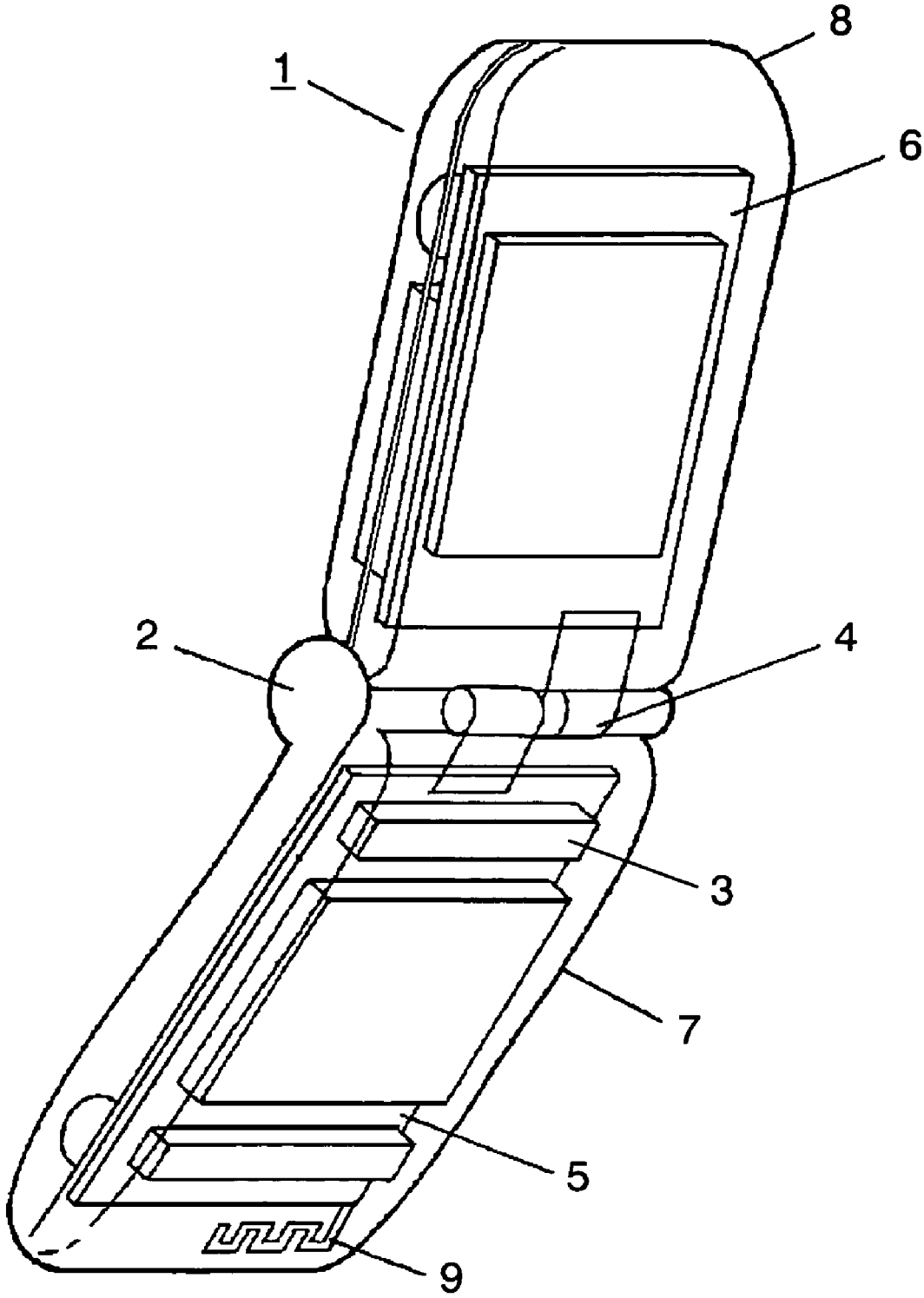
FIG. 1 is a perspective view of a portable transceiver in accordance with a first exemplary embodiment of the present invention.

Exemplary embodiments of the present invention are demonstrated hereinafter with reference to the accompanying drawings and it is emphasized that the drawings do not show actual dimensional relations between respective elements. In the description, the same elements are denoted with the same reference marks, and the descriptions of those elements are omitted.

First Exemplary Embodiment

The first embodiment of the present invention is described hereinafter with reference to FIG. 1.

Antenna section 3 of openable and closable portable transceiver 1 is disposed near hinge section 2 and close to coupling section 4.

Keyboard side board 5, which is a first circuit board, is coupled with liquid crystal display side board 6, which is a second circuit board, via coupling section 4. Keyboard side board 5 is covered with first housing 7 having an input section at its surface. Liquid crystal display side board 6 is covered with second housing 8 having a display section. Element section 9 is coupled with a ground which is opposite antenna section 3 at keyboard side board 5 and formed at an end side of the board, and formed of a meander shaped metal plate.

Next, characteristics of portable transceiver 1 of the present embodiment are described hereinafter.

Figure 2:
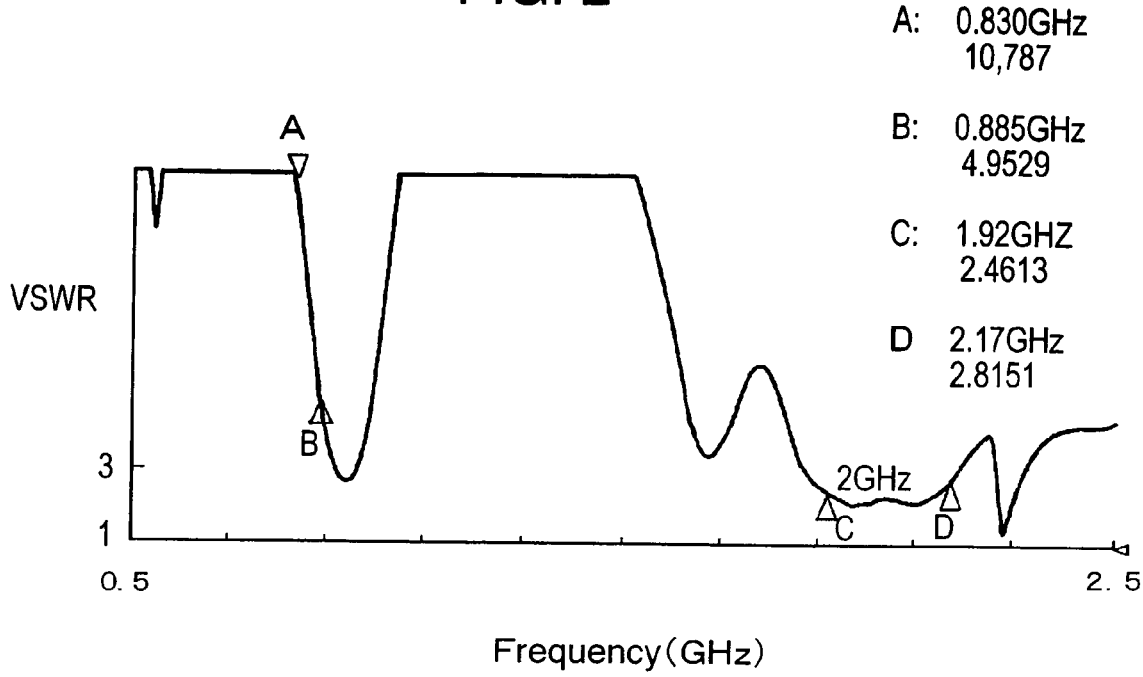
FIG. 2 shows a VSWR characteristic of the portable transceiver in accordance with the first exemplary embodiment of the present invention.

A Voltage Standing Wave Ratio characteristic (hereinafter referred to as "VSWR characteristic") of the present structure adding element section 9 is shown in FIG. 2. A VSWR characteristic without adding element section 9 is shown in FIG. 3.

Figure 3:
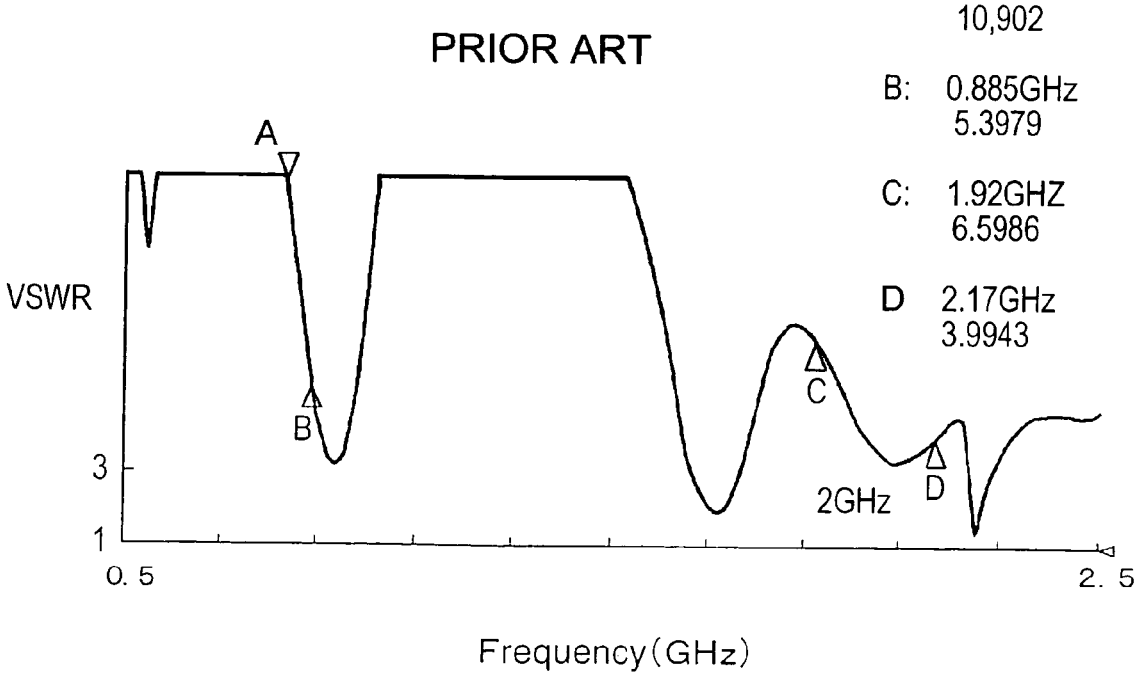
FIG. 3 PRIOR ART
FIG. 3 shows a VSWR characteristic of a conventional portable transceiver.

Point "A", "B", "C" and "D" in FIGS. 2–3 respectively show VSWRs of frequencies of 0.830 GHz, 0.885 GHz, 1.92 GHz and 2.17 GHz. For example, VSWR is 2.4613 at "C" point (1.92 GHz) in FIG. 2. As shown in FIG. 2, the VSWR characteristic approaches 1 at 2 GHz band. Frequency bands whose VSWR characteristics are less than 3 are approximately 300 MHz (i.e., a range between points "C" and "D").

This shows that radio frequency power from the circuit board side is efficiently supplied to the antenna side.

As a result, using the structure discussed above, a broadband can be realized at 2 GHz band. On the other hand, as shown in FIG. 3, in a case where element section 9 is not formed, frequency bands whose VSWR characteristics are less than 3 can not be obtained at 2 GHz band. In a word, a broadband can not be realized.

As discussed above, a broadband can be realized by forming antenna section 3 disposed close to coupling section 4 and element section 9, which is opposite antenna section 3, formed at an end side of the board, and coupled with a ground. The reason the broadband can be realized is that current distribution, which has concentrated on antenna section 3 and coupling section 4, is dispersed at a side of element section 9, so that an input impedance of antenna section 3 can be high impedance. At this time, in order to produce resonance, element section 9 is formed in length to be approximately half wavelength of a desirable frequency.

In a word, a length of element section 9 is structured so that an electrical length becomes $\lambda/2$, where $\lambda$ denotes a wavelength of the desirable frequency which produces resonance.

Second Exemplary Embodiment

Figure 4:
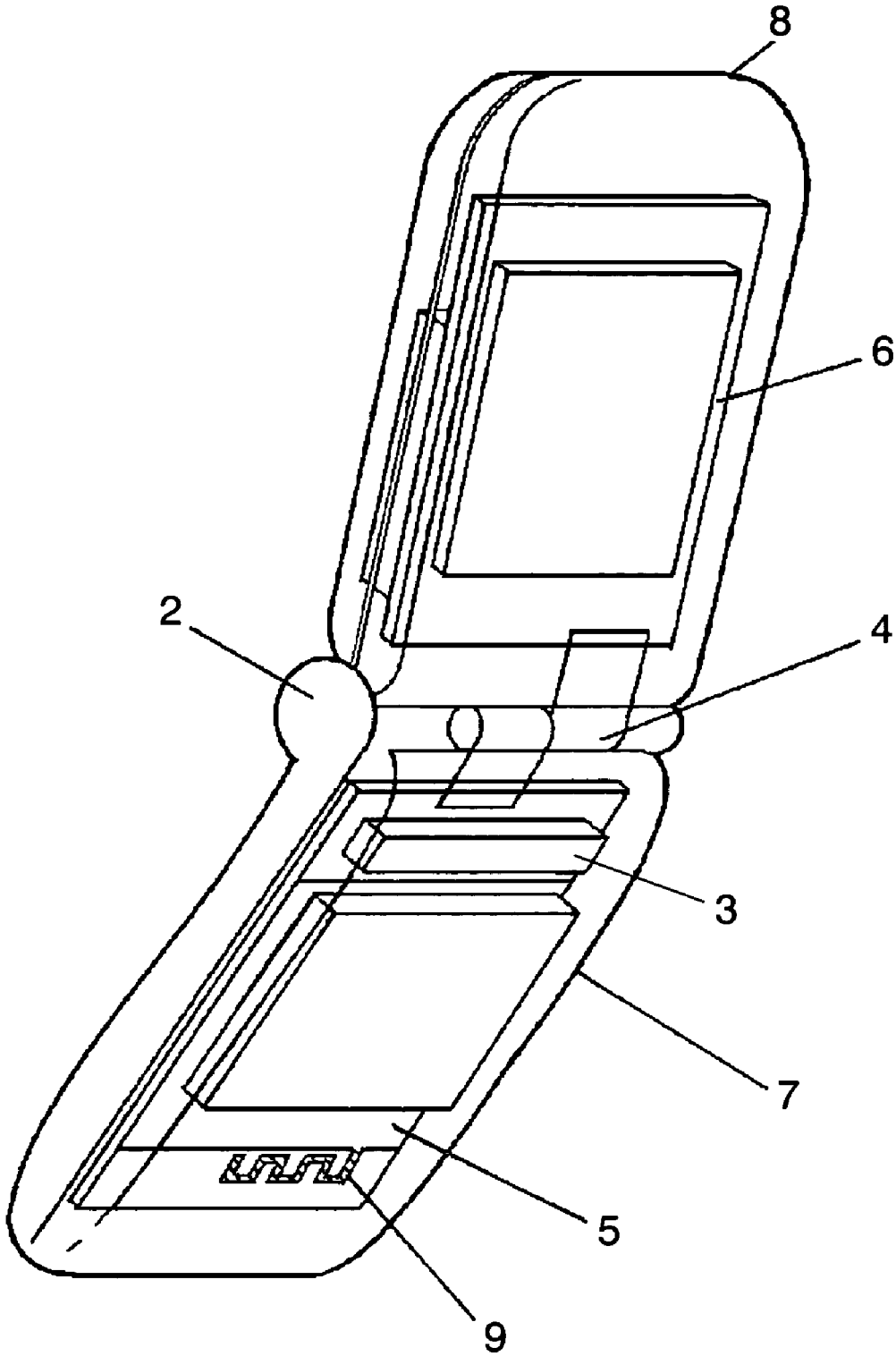
FIG. 4 is a perspective view of a portable transceiver in accordance with a second exemplary embodiment of the present invention.

The second embodiment of the present invention is described hereinafter with reference to FIG. 4.

Antenna section 3 is disposed near hinge section 2 and close to coupling section 4. Keyboard side board 5, which is a first circuit board, is coupled with liquid crystal display side board 6, which is a second circuit board, via coupling section 4. Keyboard side board 5 is covered with first housing 7 having an input section at its surface. Liquid crystal display side board 6 is covered with second housing 8 having a display section. Element section 9 is formed of a pattern on the board, where the pattern is extended from a ground pattern of keyboard side board 5.

By using the pattern on the board discussed above, the same effect can be obtained as the case where the metal plate is used. In addition, costs can be cut down because element section 9 is formed of the pattern on the board.

Third Exemplary Embodiment

The third embodiment of the present invention is described hereinafter with reference to FIG. 5.

Figure 5:
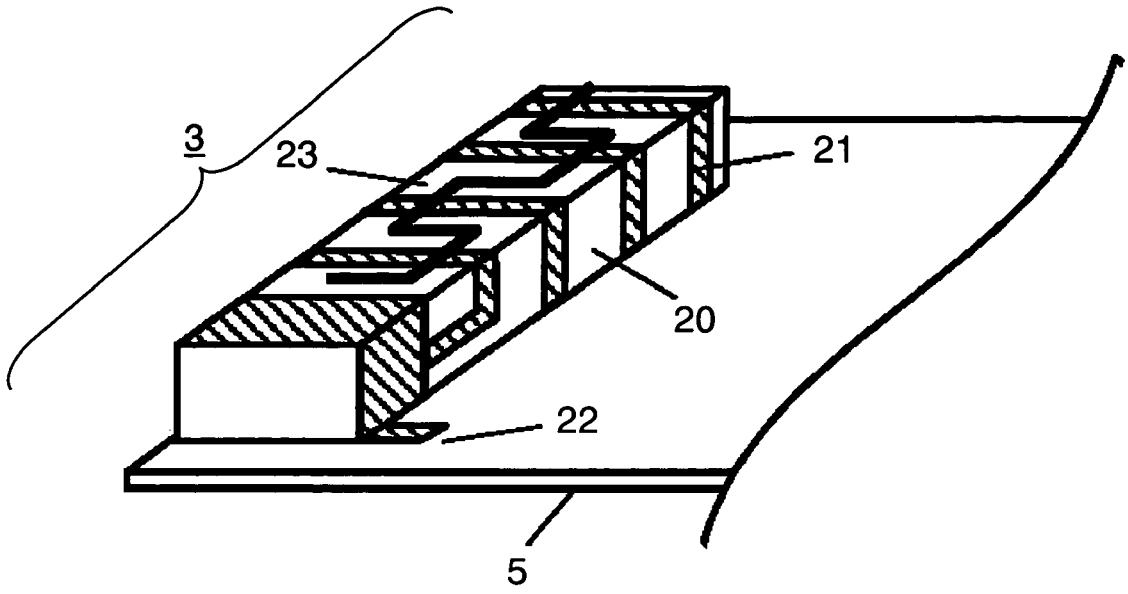
FIG. 5 is a perspective view of an antenna section in accordance with a third exemplary embodiment of the present invention.

FIG. 5 is an enlarged view of an example of antenna section 3 of FIG. 1.

Antenna section 3 is formed of helical element 21, feeding section 22 and meander element 23. Electric power is supplied to helical element 21, feeding section 22 is coupled with a power supply terminal on resin substrate 20, and meander element 23 is insulated from helical element 21.

As discussed above, antenna section 3 is formed of a plurality of elements including helical element 21 and meander element 23.

As a result, antenna section 3 can treat a plurality of frequency bands corresponding to respective elements.

In a word, a portable transceiver having a broad band characteristic can be provided at a frequency band corresponding to any one of elements.

Fourth Exemplary Embodiment

The fourth embodiment of the present invention is described hereinafter with reference to FIG. 6.

Figure 6:
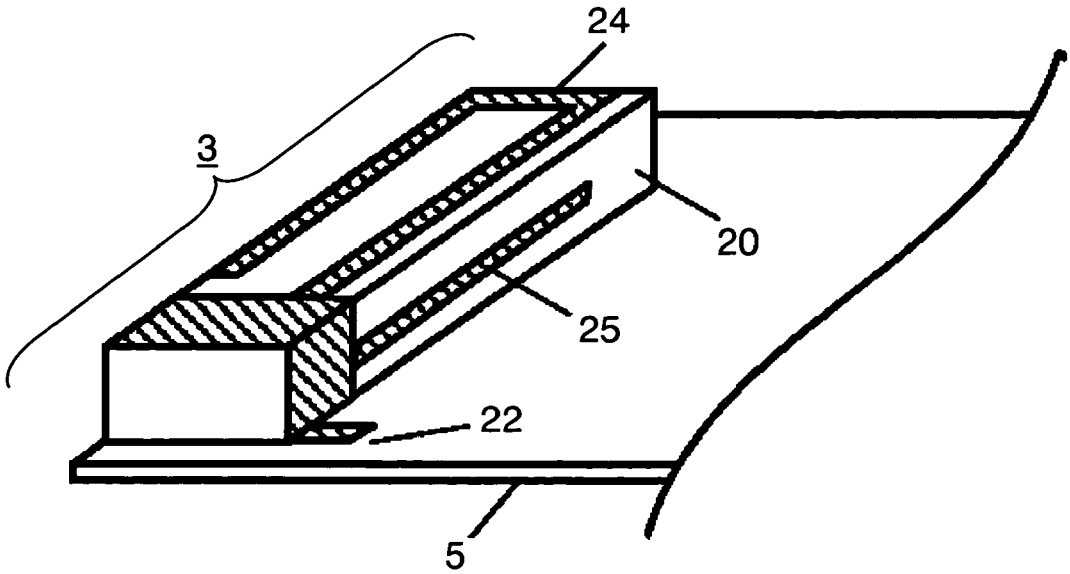
FIG. 6 is a perspective view of an antenna section in accordance with a fourth exemplary embodiment of the present invention.

FIG. 6 is an enlarged view of another example of antenna section 3 of FIG. 1.

Antenna section 3 is formed of first folding type element 24, feeding section 22 and second element 25. Electric power is supplied to first folding type element 24, feeding section 22 is coupled with a power supply terminal on resin substrate 20, and second element 25 is coupled with first folding type element 24.

As discussed above, antenna section 3 is formed of a plurality of elements including first folding type element 24 and second folding type element 25.

As a result, antenna section 3 can treat a plurality of frequency bands corresponding to respective elements.

In a word, a portable transceiver having a broad band characteristic can be provided at a frequency band corresponding to any one of elements.

Fifth Exemplary Embodiment

The fifth embodiment of the present invention is described hereinafter with reference to FIG. 7.

Figure 7:
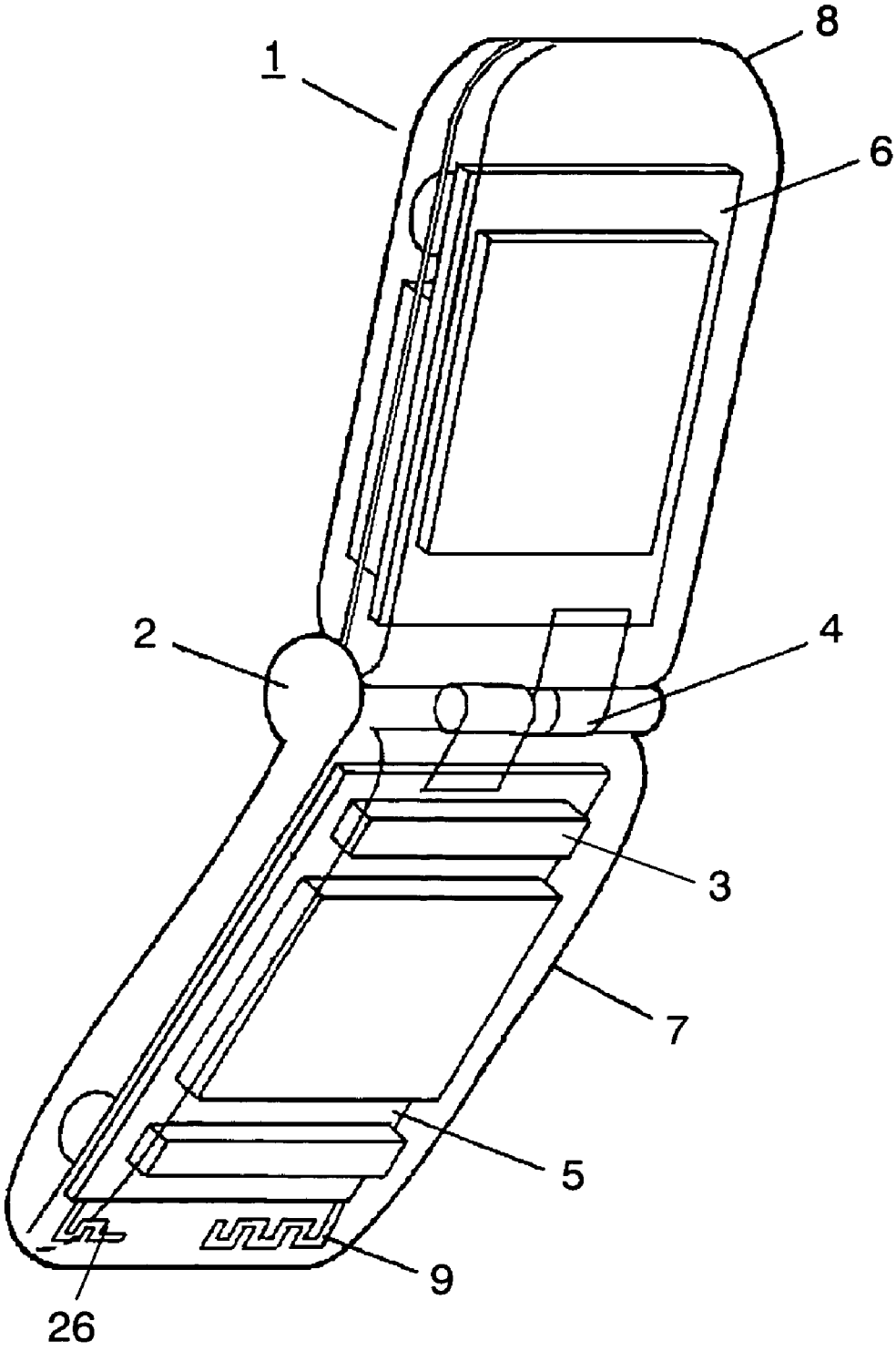
FIG. 7 is a perspective view of a portable transceiver in accordance with a fifth exemplary embodiment of the present invention.

Antenna section 3 in FIG. 7 is formed of first folding type element 24, to which electric power is supplied, shown in FIG. 6 and second element 25 coupled therewith. Antenna section 3 is disposed near hinge section 2 and close to coupling section 4.

Keyboard side board 5, which is a first circuit board, is coupled with liquid crystal display side board 6, which is a second circuit board, via coupling section 4.

Keyboard side board 5 is covered with first housing 7 having an input section at its surface. Liquid crystal display side board 6 is covered with second housing 8 having a display section. First element section 9 and second element section 26 each is formed of a meander shaped metal plate. They are coupled with a ground which is opposite antenna section 3 at keyboard side board 5 and formed at an end side of the board.

Using the structure discussed above, first element section 9 corresponds to a first frequency band and second element section 26 corresponds to a second frequency band, so that each current distribution concentrates. Therefore, a broad band can be realized at a plurality of frequency bands. Thus, a portable transceiver having such a characteristic can be provided.

Sixth Exemplary Embodiment

Figure 8:
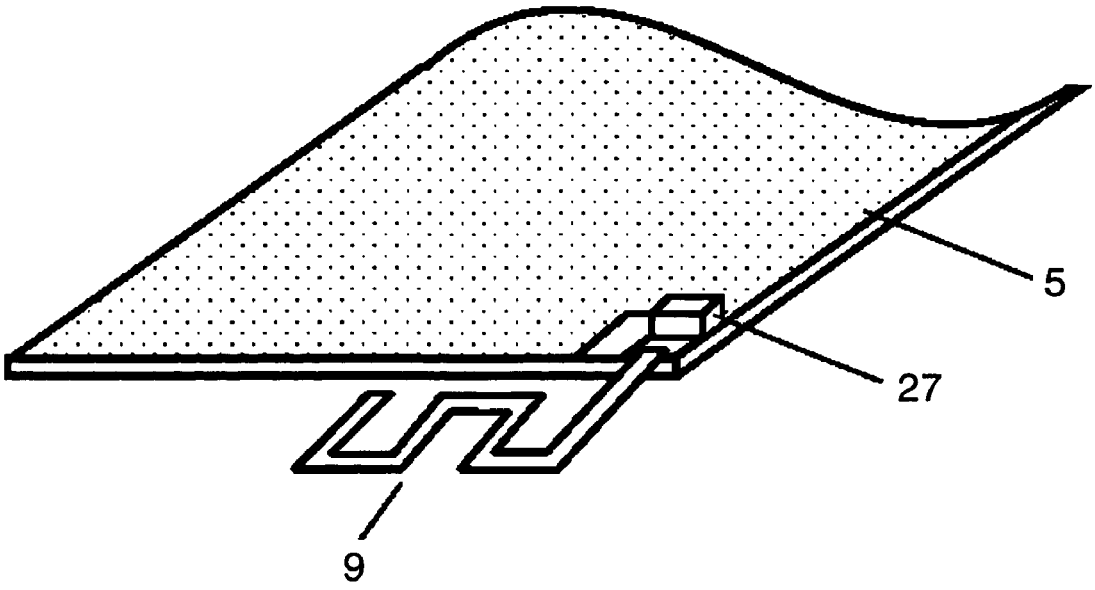
FIG. 8 is a perspective view of an element section in accordance with a sixth exemplary embodiment of the present invention.
Figure 9:
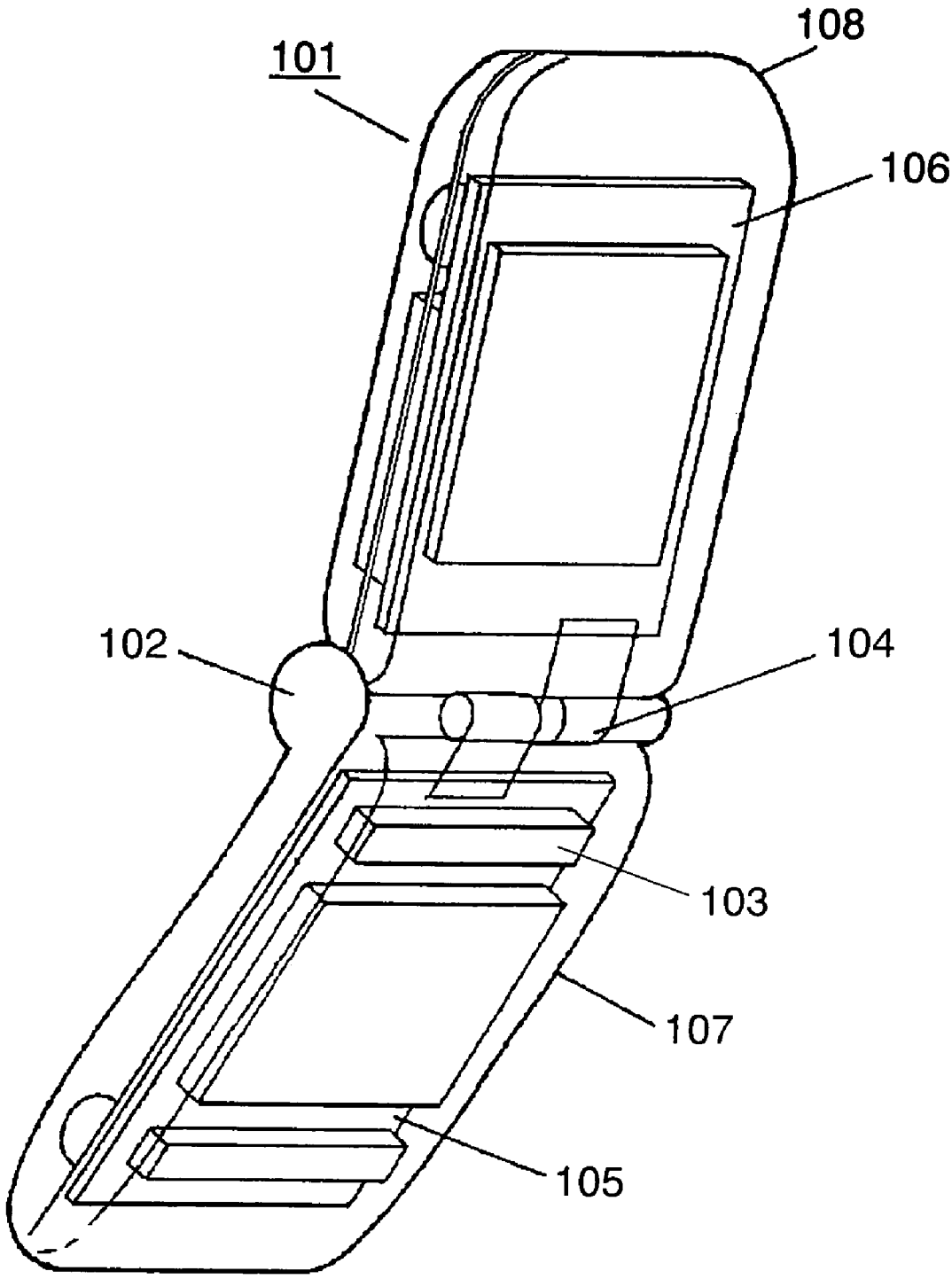
FIG. 9 PRIOR ART
FIG. 9 is a perspective view of a conventional portable transceiver.

The sixth embodiment of the present invention is described hereinafter with reference to FIG. 8.

First element section 9 is formed of a meander shaped metal plate and coupled with a ground, which is opposite antenna section 3 at keyboard side board 5 and formed at an end side of the board, via inductance section 27.

As discussed above, a length of an element section can be shortened by coupling via inductance section 27, so that the element section can be miniaturized. A chip coil or the like can be used as the inductance section.

The present invention provides a portable transceiver includes a first housing having a first circuit board in its inside and an input section at its surface, a second housing having a second circuit board in its inside and a display section at its surface, and a coupling section for electrically coupling the first circuit board with the second circuit board. In addition, an antenna section and an element section are disposed at one of the first circuit board and the second circuit board. Besides, the first housing and the second housing are coupled with each other via a hinge section to be folded. By using the structure mentioned above, electric currents concentrate on the element section, so that an input impedance of an antenna can be a broad band.

Further, in the present invention, the antenna section and the element section may be respectively disposed near two sides, which are opposite to each other, of the circuit board. In this case, electric currents can concentrate on the element section, and an input impedance of the antenna can be a broad band.

Still further, in the present invention, the element section may be formed of a pattern on the circuit board. In this case, electric currents can concentrate on the element section, and an input impedance of the antenna can be a broad band.

Yet further, in the present invention, the element section is formed of a metal plate. In this case, electric currents can concentrate on the element section, and an input impedance of the antenna can be a broad band.

Furthermore, in the present invention, a length of the element section may be an electrical length of $\lambda/2$. In this case, electric currents can concentrate on the element section, and an input impedance of the antenna can be a broad band.

In the present invention, the antenna section may be formed of the helical element and the meander element. In this case, electric currents can concentrate on the element section, and an input impedance of the antenna can be a broad band.

In the present invention, the antenna section may be formed of a plurality of folding type elements to which electric power is supplied. In this case, electric currents can concentrate on the element section, and an input impedance of the antenna can be a broad band.

In the present invention, a plurality of element sections may be formed. In this case, electric currents can concentrate on the plurality of element sections, and an input impedance of the antenna can be a broad band at a plurality of frequency bands.

In the present invention, the element section and the coupling section of the circuit board may be coupled with each other via the inductance section. In this case, electric currents can concentrate on the element section, and an input impedance of the antenna can be a broad band.

As discussed above, the present invention provides a portable transceiver includes two circuit boards and the coupling section for electrically coupling them. The antenna section and the element section are disposed at one of the circuit boards, and two housing are coupled with each other via the hinge section and can be folded. Using the structure discussed above, the portable transceiver having a broad band characteristic can be provided.

INDUSTRIAL APPLICABILITY

An antenna of the present invention can be incorporated in a portable transceiver, which requires a broad band, and widely applied.

The invention claimed is:

1. A portable broadband transceiver comprising:

a first housing having a first circuit board in its inside and an input section at its surface;

a second housing having a second circuit board in its inside and a display section at its surface;

a coupling section for electrically coupling the first circuit board with the second circuit board;

a hinge section for coupling the first housing with the second housing and capable of folding them;

an antenna section within the first housing between the coupling section and the first circuit board; and an element section within the first housing, the element section connected to a ground, the first circuit board located between the element section and the antenna section, the element section for dispersing current concentrated at the antenna section and the coupling section for providing the antenna section with a high input impedance, the element section and the antenna section having a voltage standing wave radio characteristic approaching 1 at a broadband frequency.

2. The portable broadband transceiver of claim 1, wherein the element section is formed in a pattern on the circuit board, which pattern extends from a ground pattern on said first circuit board.

3. The portable broadband transceiver of claim 1, wherein the element section comprises a metal plate.

4. The portable broadband transceiver of claim 1, wherein the element section has a length approximately half of the wavelength of a resonance frequency of the antenna section and the element section.

5. The portable broadband transceiver of claim 1, wherein the antenna section comprises a helical element, a feeding section, and a meander element.

6. The portable broadband transceiver of claim 5, wherein the feeding section is coupled with a power supply terminal on a substrate, and the meander element is insulated from the helical element.

7. The portable broadband transceiver of claim 6, wherein the antenna section comprises a plurality of helical elements and meander elements, each helical element and each meander element having a different frequency band, thereby enabling the antenna section to operate a plurality of frequency bands.

8. The portable broadband transceiver of claim 5, wherein the helical element is formed around the substrate and the meander element is located on top of the helical element, the substrate is on the first circuit board, and the feeding section electrically connects the helical element to a circuit on the first circuit board.

9. The portable broadband transceiver of claim 8, wherein the meander element is formed in the shape of a square wave.

10. The portable broadband transceiver of claim 1, wherein the antenna section comprises a folding type element, a feeding section coupled to a power supply terminal on a resin substrate, and a second element coupled with the folding type element.

11. The portable broadband transceiver of claim 10, the antenna section comprises a plurality of folding elements and second elements, each folding element and each second element having a different frequency band, thereby enabling the antenna section to operate a plurality of frequency bands.

12. The portable broadband transceiver of claim 10, wherein folding element is located on a top surface of the substrate, the second element is located on a side of the substrate, and the feeding section couples the folding element and the second element to the first circuit board.

13. The portable broadband transceiver of claim 12, wherein the folding element has a "U" shape.

14. The portable broadband transceiver of claim 12, wherein the second element is linear.

15. The portable broadband transceiver of claim 1, comprising a plurality of element sections.

16. The portable broadband transceiver of claim 1, wherein the element section and the circuit board are coupled with each other via an inductance section.

17. The portable broadband transceiver of claim 1, wherein the element section and the antenna section have a voltage standing wave radio characteristic approaching 1 at a 2 GHz band.

18. The portable broadband transceiver of claim 1, further comprising a second element section having a different configuration than the first element section, whereby the second element section has a different broadband frequency than the first element section.

19. The portable broadband transceiver of claim 1, wherein the element section is formed in the shape of a square wave.

* * * * *